United States Patent [19]

Flaschar

[11] 4,154,072

[45] May 15, 1979

[54] LOCK SEALING DEVICE

[76] Inventor: Will Flaschar, 5207-D1 N. Dixie Hwy., Fort Lauderdale, Fla. 33334

[21] Appl. No.: 908,449

[22] Filed: May 22, 1978

[51] Int. Cl.[2] ..... E05B 17/18

[52] U.S. Cl. ..... 70/455

[58] Field of Search ..... 70/455, 423; 220/306, 220/307; 222/153, 546, 556; 215/211, 224, 343, 344, 345

[56] References Cited

U.S. PATENT DOCUMENTS

| | | | |
|---|---|---|---|
| 3,740,981 | 6/1973 | Patriquim | 70/455 |
| 3,854,618 | 12/1974 | Beghmini | 215/307 |
| 3,860,135 | 1/1975 | Yung | 215/213 |

*Primary Examiner*—Robert L. Wolfe

*Attorney, Agent, or Firm*—Wegner, Stellman, McCord, Wiles & Wood

[57] ABSTRACT

A lock sealing device is provided which has a male and a female portion joined by a hinge. The hinge is connected to an open end of the female portion and to a closed end of the male portion. The male and female portions have interengaging parts to effect a seal therebetween. The male portion has a shape to engage with a lock head to further seal the key entry area of the lock. A guide surface is provided on the female portion to guide and compress the engaging part of the male portion into sealing relation in the female portion.

8 Claims, 6 Drawing Figures

FIG. 1
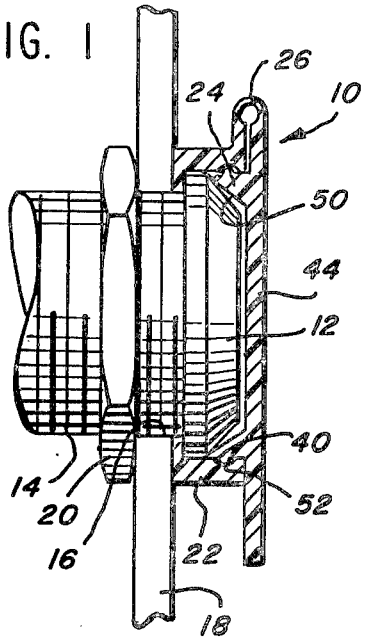
FIG. 2
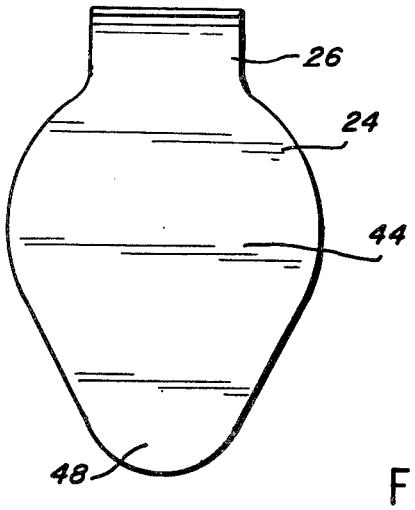
FIG. 5
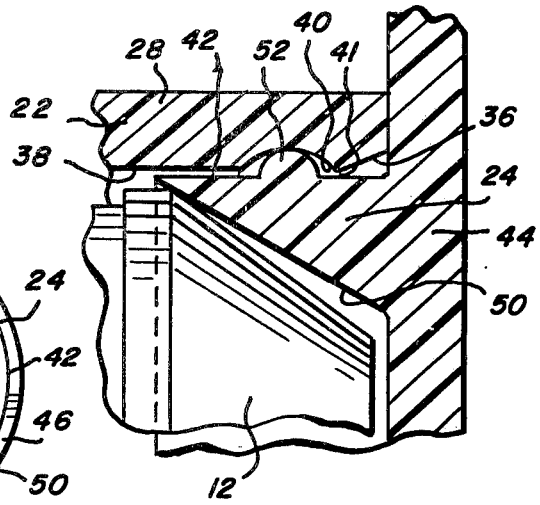
FIG. 3
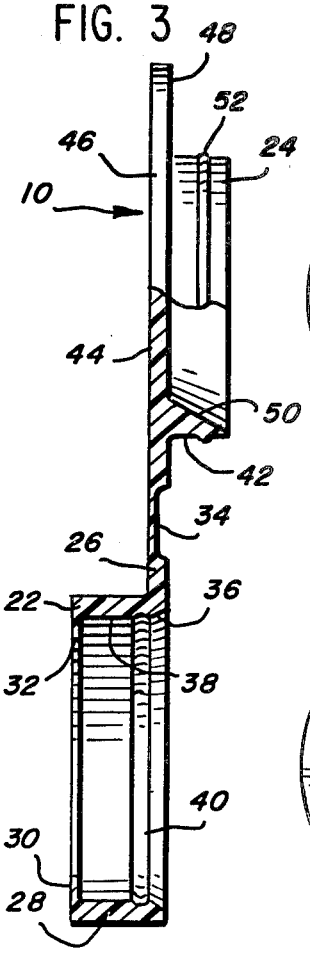
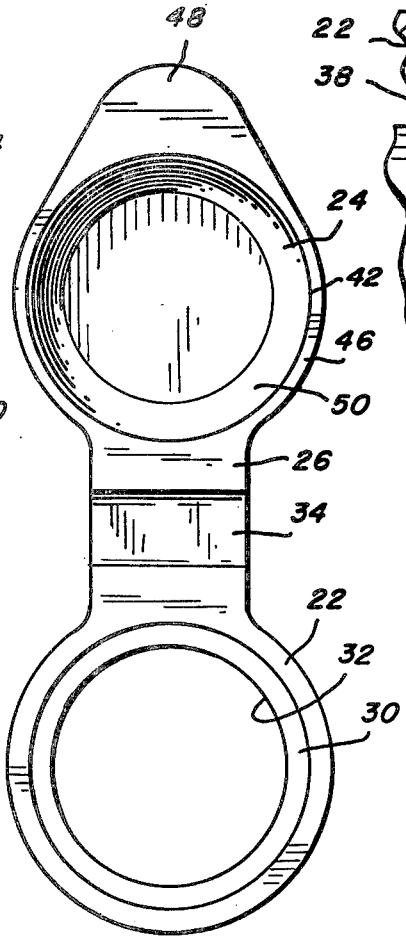
FIG. 4
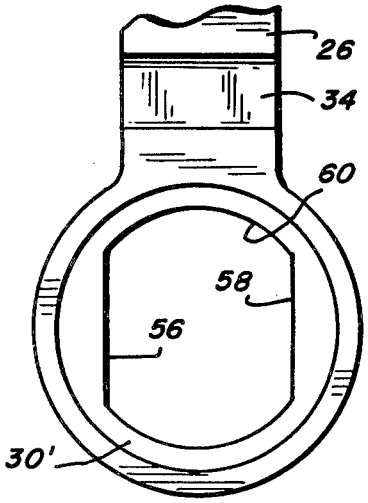
FIG. 6

LOCK SEALING DEVICE

BACKGROUND OF THE INVENTION

1. Field of the Invention

This invention relates to a sealing device for a lock and, more particularly, to a device for protecting a key entry area of a lock from contamination caused by dust, moisture, spray, and the like.

2. Description of the Prior Art

Locks on vehicles and structures that are exposed to hostile environments can deteriorate or become so contaminated from foreign material that they will not function either due to the accumulation of foreign material, or due to corrosion caused by the foreign material. For instance, the key entry area on trucks and cars is constantly exposed to salt spray, dirt spray, wind and rain, to name a few of the foreign materials that gain entry into the inside of the lock and cause jamming or corrosion therein.

Efforts have been made to provide covers for locks which are secured to the lock opening to prevent the more obvious intrusions of contaminants. One such device is shown in the U.S. Pat. No. 3,740,981 in the name of George P. Patriquin. However, the Patriquin device does not provide any positive seals between the two elements of the closure and, in fact, the device provides openings through which contaminants can gain entry to the enclosed area. Another such lock cover device is shown in U.S. Pat. No. 4,023,388 in the name of Gabor Morvai. In the Morvai device, a special hinge is provided whereby the cover for the closure is either in a fully opened or a fully closed position, but the device does not provide any positive seals for preventing ingress of contaminants into the enclosed area.

SUMMARY OF THE INVENTION

The present invention overcomes the problems existing in the prior art devices and provides a closure device for locks which is positively attached to the lock and includes structure for positively sealing the inside of the device from contaminants. The seal is provided by interengaging parts on a male and female portion of the body of the device and by engagement between the male portion and the lock head. The male and female portions are hinged and the male portion has a tab for separating the male from the female portion when desired.

BRIEF DESCRIPTION OF THE DRAWINGS

The details of construction and operation of the invention are more fully described with reference to the accompanying drawings which form a part hereof and in which like reference numerals refer to like parts throughout.

In the drawings:

FIG. 1 is a side cross-sectional view of my improved lock sealing device in position on a lock head;

FIG. 2 is a front view of the lock sealing device of FIG. 1;

FIG. 3 is a side view, partially in cross section, of the lock sealing device disassembled from a lock and with the male portion disengaged from the female portion;

FIG. 4 is a view looking toward the lock sealing device of FIG. 3 from the right side thereof;

FIG. 5 is an enlarged, broken away view of the interengagement between the male and female portions and the engagement between the male portion and the lock head; and, FIG. 6 is a partial view of a modified form of the female portion of the device.

DECRIPTION OF THE PREFERRED EMBODIMENT

Referring particularly to FIG. 1, a lock sealing device is shown in the closed position and is generally designated 10. The sealing device 10 is made from an appropriate material, such as a flexible plastic, or the like, and is shown assembled to the head 12 of a lock 14, which lock 14 is secured in an opening 16 in a panel 18 of, for instance, a door of a vehicle. The lock sealing device 10 is secured to the lock 14 and to the panel 18 by a part of the sealing device being trapped between an overhanging portion of the head 12 and the panel 18 when a nut 20 is threaded on the body of the lock 14 and is tightened against the opposite side of the panel 18. The specific connection between the lock sealing device 10 and the lock head 12 and the panel 18 will be described more in detail hereinafter.

Referring now generally to FIGS. 1 through 5, the lock sealing device 10 is comprised of a female portion 22 and a male portion 24 which are joined together by a hinge 26. The female portion 22 has a tubular side wall 28 which has an inwardly extending flange 30 integrally formed at one end thereof. The flange 30 defines an opening 32 which, in the form illustrated in FIGS. 3 and 4, is circular in configuration. Likewise, the tubular wall 28 is shown circular or cylindrical in configuration when taken in cross section along a plane perpendicular to the axis thereof, although it is to be understood that the configuration could be oblong or any other appropriate shape. The hinge 26, which has a reduced thickness portion 34 midway between the male portion 24 and the female portion 22, is shown integrally formed with the tubular side wall 28 of the female portion 22 along the open end thereof, said open end being the end of said tubular side wall 28 opposite to the end having the flange 30 thereon. The hinged or open end of the female portion 22 has a tapered or conically-shaped wall 36 converging into the opening or inside wall 38 defining the inside of the female portion 22. The tapered wall 36 merges with an elongate concave groove 40 formed continuously about the inside wall 38 of the tubular side wall 28. The groove 40 is not circular in cross section, but is elongate and concave in the direction parallel to the axis of the female portion 22. Thus, the tapered wall 36 merges into the entry edge 41 of the elongate groove 40 with the plane containing the centerline or midportion of the continuous groove 40 being spaced a predetermined distance from the plane defining the end wall of the female portion 22.

The male portion 24 has an exterior wall 42 which is sized to mate inside the tubular wall 28 of the female portion 22. The exterior wall 42 is joined with a cap 44 disposed transverse thereto and closes one end of said portion 24. The cap 44 extends outwardly beyond the wall 42 to form a continuous lip 46 overhanging said wall 42. The lip 46 is connected to the hinge 26 on one side of the male portion 24. A tab 48 extends outwardly beyond the confines of the lip 46 on the side of the male portion 24 opposite to the connection of the cap 44 to the hinge 26. The circumferential edge of the lip 46 generally aligns with the outside surface of tubular wall 28 of the female portion 22 and the tab 48 extends beyond said tubular wall 28 of the female portion 22 when the male portion 24 is nested in the female portion 22.

The exterior wall 42 of the male portion 24 has a tapered inside wall 50 which tapers from the cap 44 to a junction with the exterior wall 42. The junction between the wall 50 and the wall 42 subscribes a circle in a plane lying parallel to said cap 44. A continuous rib 52 is formed about the exterior wall 42 with the centerline of the rib 52 lying in a plane spaced from the lip 46 by an amount substantially equal to the spacing of the plane containing the centerline of the groove 40 from the plane of the end wall of the female portion 22. It is noted that the rib 52 is substantially circular in cross section and, as will be noted in FIGS. 1 and 5, the rib 52 will seat in the low point of the tapered groove 40 in the female portion 22 when the male portion 24 is seated in the female portion. The axial length of the rib 52 is less than the axial length of the groove 40.

The improved lock sealing device is assembled to a lock by passing the body of the lock 14 through the opening 32 in the female portion 22 so as to bring the overhanging portion of the head 12 into engagement with the flange 30. The body of the lock 14 is then passed through the opening 16 in the panel 18 whereupon the nut 20 can be threaded to a point to secure the lock sealing device 10 and the lock head 12 securely against the panel 18. To seal the keyway entry into the lock head 12 from contamination, the male portion 24 is pivoted about the hinge 26 until the extended end of the wall 42 of the male portion 24 is aligned with the tapered wall 36 in the female portion 22. Additional movement of the male portion 24 toward the female portion 22 will engage the rib 52 with the tapered wall 36 whereupon pressure on the male portion 24 will guide the rib 52 and depress the rib and male portion 24 until the rib 52 snaps over the entry edge 41 of the groove 40 whereupon the concave elongate shape of the groove 40 will ideally nest the rib 52 in the midportion thereof. The resilience of the wall 42 of the male portion 24 and the wall 28 of the female portion 22 will create a seal between the rib 52 and the groove 40. With the lip 46 of the male portion 24 bearing against the end face of the female portion 22, the tapered wall 50 in the male portion 24 will, likewise, engage with the tapered head 12 of the lock 14 to form a further seal between the male member 24 and the lock head 12 so as to create a seal for the keyhole entry into the lock.

In the form of invention shown, for instance, in FIG. 5, the engagement of the wall 50 with the tapered lock head 12 is along the bottom edge of the taper of the lock head. However, it is to be understood that in some cases the tapered wall 50 may engage with the upper edge of the tapered lock head 12 or may coincide with the tapered wall of the lock head 12, all of which will create the seal between the male portion 24 and the head 12. With the double seal between the rib 52 and the groove 40 and between the tapered wall 50 and the head 12, moisture and foreign matter will have very little chance of gaining access to the keyhole entry to the lock. To gain access to the keyhole entry to the lock, pressure is applied on the tab 48 from below which will separate the male portion 24 from the female portion 22 with the hinge 26 retaining the male portion 24 tethered to the female portion 22 until it is desired to reseal the lock head 12.

As shown in FIG. 6, the flange 30' has two flats 56 and 58 on opposite sides thereof so as to define a somewhat oblong opening 60. This particular female member is used with a lock 14 that has two flats formed on the opposite sides of the body of the lock so that the flats 56 and 58 will nest with the flats on the body portion of the lock 14 with the flange 30' trapped between the head 12 and the panel 18 of the door. In this way, the lock sealing device 10 will not rotate relative to the lock 14 due to the flats 56 and 58 and their coaction with the flats on the body of the lock 14. In all other respects, the lock sealing device 10 of FIG. 6 functions in the same manner as the lock sealing device of FIGS. 1 through 5. The tab 48 could be formed in the nature of a pair of tabs extending out from the sides of the lip 46 as distinguished from extending in the direction opposite to the hinge 26 without departing from the spirit of the invention.

I claim:

1. A lock sealing device comprising a body member having a male and a female portion joined by a hinge, said female portion having a tubular side wall with an inwardly directed flange at one end thereof, a tapered groove formed continuously about the inside of said tubular side wall, said male portion having an exterior wall adapted to mate inside the tubular wall of said female portion, said male portion having a cap closing off one end of said tubular wall, a tab formed integrally with said cap and projecting radially outward from said male portion, a continuous rib formed about the outside of said exterior wall, whereby said male portion can be forced into said female portion with said rib resiliently seating in said groove to seal the two portions relative to each other.

2. A lock sealing device as claimed in claim 1 wherein said hinge is connected to said female portion at an end opposite to the end having said flange and is connected to the male portion at the end having said cap.

3. A lock sealing device as claimed in claim 1 wherein said groove is spaced axially inward from said end opposite to the end having said flange and said rib is spaced axially from said cap an amount equal to said axial spacing of said groove from said end.

4. A lock sealing device as claimed in claim 1 wherein said cap has a continuous lip extending outwardly beyond said exterior wall to form a lip, and said tab is formed integrally with said lip.

5. A lock sealing device as claimed in claim 1 wherein said female portion has a tapered entry into the inside thereof to guide and compress said rib as said male portion is forced into said female portion.

6. A lock sealing device as claimed in claim 1 wherein said male portion has a tapered wall inside said exterior wall which tapered wall is adapted to engage with a lock head to seal the key entry area of the lock from contamination.

7. A lock sealing device comprising a body member molded of a resilient material and having a male and a female portion joined by a hinge, said female portion having a tubular side wall with an inwardly directed flange at one end thereof, said hinge connecting to said female portion at an end opposite to said end having said flange, a tapered groove formed continuously about the inside of said tubular side wall and spaced axially inward from said end having said hinge connection, said male portion having an exterior wall sized to mate inside the tubular wall of said female portion, said male portion having a cap closing off one end of said tubular wall and extending outwardly beyond said exterior wall to form an overhanging lip, said male portion having a tapered wall inside said exterior wall which tapered wall joins with said exterior wall at an end opposite to said end having said cap, said hinge connecting to said lip on said cap on said male portion, a tab formed integrally with said lip and projecting radially outward beyond said lip on the opposite side of said male portion from said hinge connection to said lip, a continuous rib formed about the outside of said exterior wall and spaced axially from said lip an amount substantially equal to the axial spacing of said groove from said end of said female portion having said hinge connection whereby said male portion can be forced into said female portion with said rib resiliently seating in said groove to seal the two portions relative to each other.

8. A lock sealing device comprising a body member molded of a resilient material and having a male and a female portion joined by a hinge, said female portion having a tubular side wall with an inwardly directed flange at one end thereof, said flange seating between the tapered head of a lock and a mounting wall with said side wall encircling said tapered head, said hinge connecting to said female portion at an end opposite to said end having said flange, a tapered groove formed continuously about the inside of said tubular side wall and spaced axially inward from said end having said hinge connection, the inside of said side wall being tapered from a wide opening at the end having said hinge connection to an opening coinciding with the size of the opening inside the female portion, said male portion having an exterior wall sized to mate inside the tubular wall of said female portion, said male portion having a cap closing off one end of said tubular wall and extending uniformly outwardly beyond said exterior wall to form an overhanging lip, said male portion having a tapered wall inside said exterior wall which tapered wall joins with said exterior wall at an end opposite to said end having said cap, said hinge connecting to said lip on said cap, a tab formed integrally with said lip and projecting radially outward beyond said lip on the opposite side of said male portion from said hinge, a continuous rib formed about the outside of said exterior wall and spaced axially from said lip an amount substantially equal to the axial spacing of said groove from said end of said female portion having said hinge connection whereby said rib on said male portion is aligned with the tapered inside of said female portion and is forced into said female portion with said rib resiliently seating in said groove to seal the two portions relative to each other, and said tapered wall in the male portion engages with said tapered head of the lock to further seal the lock from exposure to outside contaminants.

* * * * *